US005572989A

United States Patent [19]

Lutz et al.

[11] Patent Number: 5,572,989

[45] Date of Patent: Nov. 12, 1996

[54] PRESSURE EQUALIZING MECHANISM FOR A DIVING MASK

[75] Inventors: James R. Lutz, Round Lake Beach; Keith D. Alaberg, Chicago; James F. Caruso, Evanston; Paul J. Doczy, Chicago; Robert S. Gelick, Evanston; Craig Scherer, Wilmette, all of Ill.

[73] Assignee: Johnson Worldwide Associates, Sturtevant, Wis.

[21] Appl. No.: 550,607

[22] Filed: Oct. 31, 1995

[51] Int. Cl.[6] ..... A62B 18/02; B63C 11/02; B63C 11/16; A61F 9/02

[52] U.S. Cl. ..... 128/201.18; 2/428; 2/452; 128/201.27; 128/201.11; 128/207.14; D24/110.2

[58] Field of Search ..... 128/201.18, 201.11, 128/201.27, 207.14; 2/428, 452; D2/234

[56] References Cited

U.S. PATENT DOCUMENTS

D. 266,031 9/1982 Sato .
D. 318,476 7/1991 Sato .
3,671,976 6/1972 Johnson et al. .
4,077,068 3/1978 Anderson .
4,241,898 12/1980 Segrest .
4,352,353 10/1982 Bolton et al. .
4,856,120 8/1989 Hart .
5,275,153 1/1994 Kay .
5,325,892 7/1994 Japuntich et al. .
5,329,643 7/1994 Sato .
5,400,779 3/1995 De Resende .
5,411,018 5/1995 Rinehart .

*Primary Examiner*—Kimberly L. Asher
*Attorney, Agent, or Firm*—Foley & Lardner

[57] ABSTRACT

An improved diving mask is disclosed. The diving mask includes a frame and a lens mounted and sealed within the frame. A flexible skirt is also mounted to the frame and designed to form a seal with a diver's face around the eyes and nose of the diver. The skirt includes a flexible nosepiece that fits over the nose of the diver. A stiff bracket is mounted to the frame and extends partially over the nosepiece. Additionally, an actuator is adjustably mounted to the bracket and cooperates with the nosepiece to selectively squeeze the nosepiece and restrict airflow through the nose of the diver.

19 Claims, 7 Drawing Sheets

FIG. 1
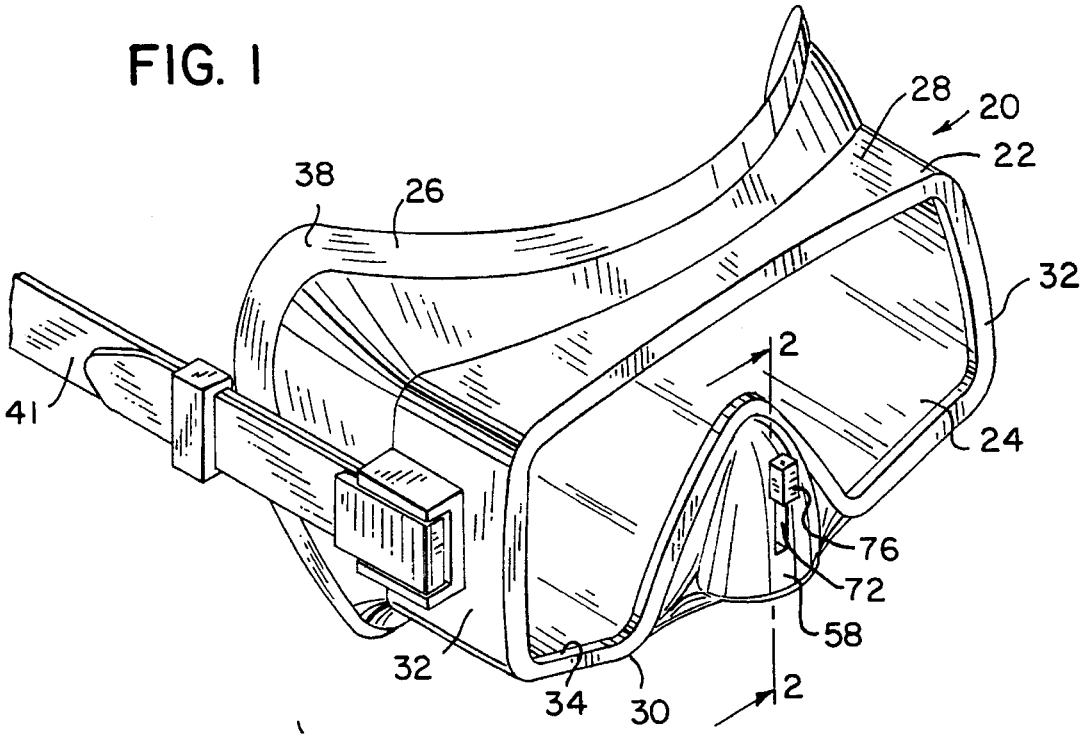
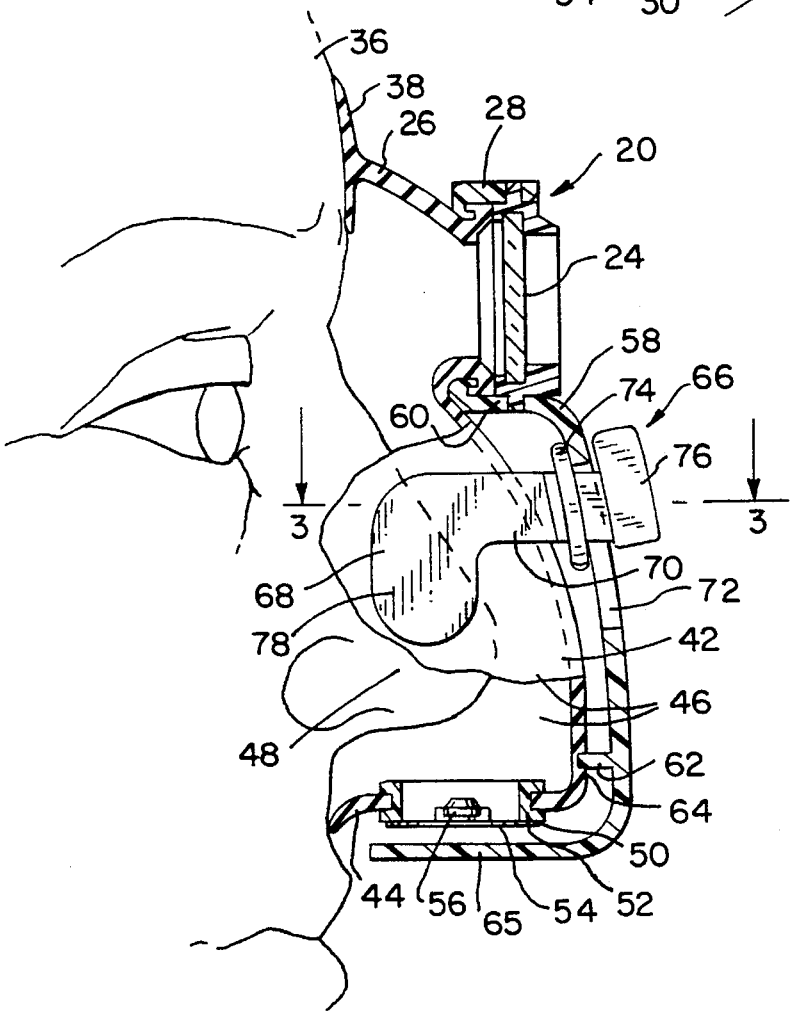
FIG. 2

FIG. 6
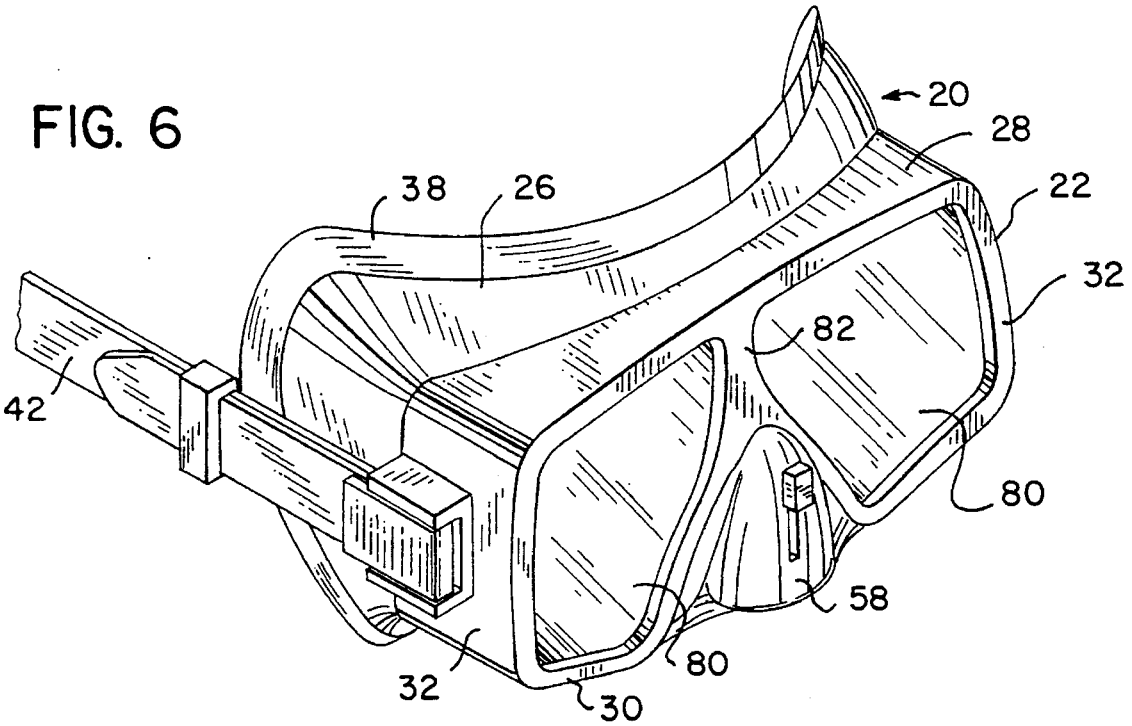
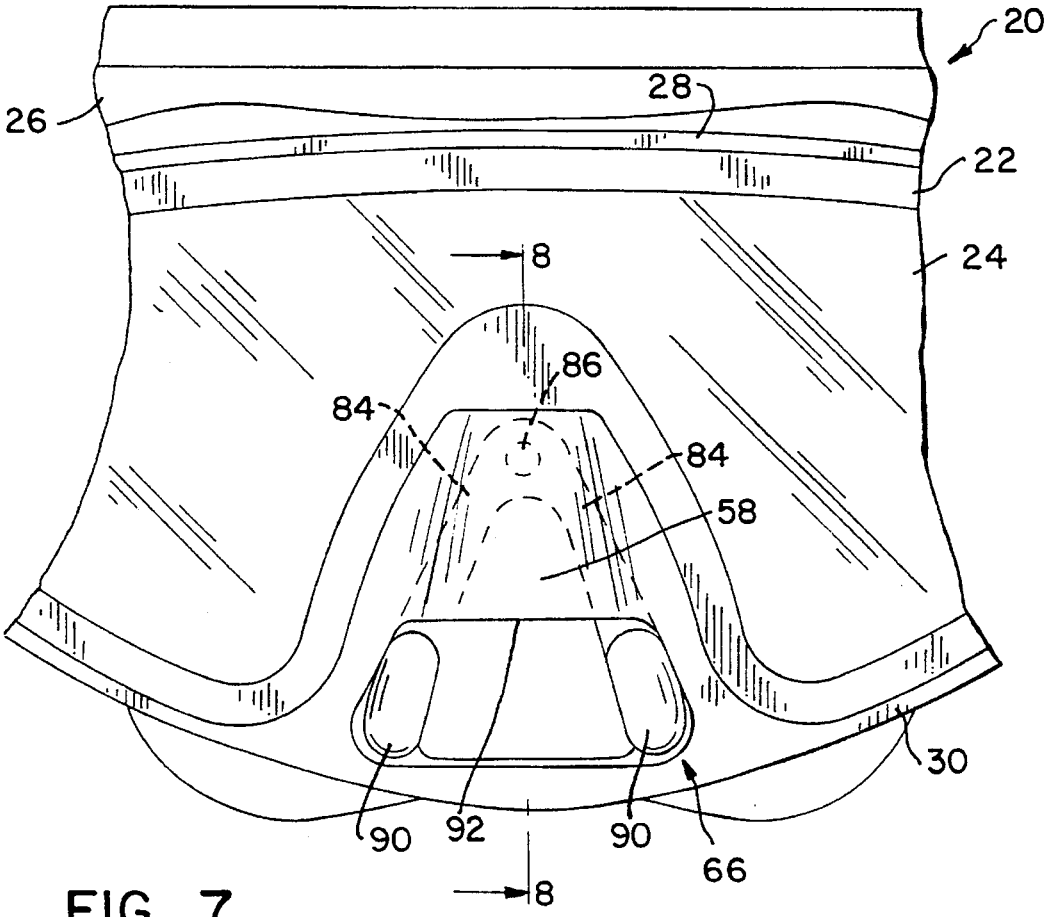
FIG. 7

PRESSURE EQUALIZING MECHANISM FOR A DIVING MASK

FIELD OF THE INVENTION

The present invention relates generally to diving masks, such as those used for scuba diving or skin diving, and particularly to an actuator system that restricts airflow through the diver's nose to help the diver with pressure equalization during descent.

BACKGROUND OF THE INVENTION

Divers, such as scuba divers and skin divers, wear diving masks that prevent water from entering the area surrounding the eyes and nose. Diving masks generally include an outer frame and a window or lens mounted to the frame in a sealed relationship. A flexible skirt is also sealingly mounted to the frame along one edge. The flexible skirt is often made of silicone and has a sealing edge configured to fit against the face of the diver around the eyes and nose. A mask strap secures the mask against the diver's face.

Often, the skirt includes a nosepiece or nose pocket configured to receive the nose of the diver. In some masks, the nosepiece is flexible to permit the diver to grasp his or her nose during descent. This may be necessary to allow the diver to equalize his internal pressure with the steadily increasing external pressure during a descent. Pressure equalization is facilitated by blocking a diver's nose and gently blowing against the blockage.

Other masks incorporate a purge valve in the base of the nosepiece. The purge valve permits the diver to purge any water that inadvertently leaked into the mask. By exhaling through his or her nose, the diver is able to force this unwanted water through the purge valve and into the surrounding environment.

A rigid plate is sometimes attached to the frame of the mask and is disposed over the nosepiece and purge valve area to provide protection of the purge valve and stability to the nosepiece area. However, this configuration can cause problems for the diver when he attempts pressure equalization by grasping his nose. The purge valve or the purge valve combined with the rigid plate render it difficult, if not impossible, for the diver to grasp his nose and restrict airflow therethrough.

Therefore, it would be advantageous to provide a mechanism for use with such a diving mask that would allow the diver to block or restrict airflow through his nose during the equalization process.

SUMMARY OF THE INVENTION

The present invention features a diving mask designed to fit over a nose and a pair of eyes of a diver. The mask creates a pocket of air bounded by its interior and at least part of the diver's face.

The diving mask comprises a frame having a top, a bottom and a pair of sides that cooperate to form at least one opening. A lens is mounted and sealed within the at least one opening. A flexible skirt is also mounted to the frame and includes a flexible nosepiece. The nosepiece has a bottom panel and a pair of side panels configured to fit over the nose of the diver. A stiff bracket is mounted to the frame to extend at least partially over the nosepiece. Also, an actuator is mounted to the bracket in cooperation with the nosepiece. Upon actuation, the actuator moves to squeeze the nose of the diver and restrict airflow therethrough.

The actuator can have a variety of configurations. For example, the actuator may include a nose clip or pinching mechanism mounted to a slide bar, which, in turn, is slidably mounted in a slot formed within the bracket. Alternately, the actuator can include a nose pinching mechanism having a pair of arms that can be moved towards one another to squeeze the diver's nose. In another configuration, the actuator includes a nose pinching mechanism mounted to a pivotable panel that may be pivoted towards the face of the diver. Also, the actuator can include an inflatable bladder positioned to restrict airflow through the nose of the diver by squeezing the sides of the nose when the bladder is inflated.

BRIEF DESCRIPTION OF THE DRAWINGS

The invention will hereafter be described with reference to the accompanying drawings wherein like reference numerals denote like elements, and:

FIG. 1 is a perspective view of a diving mask according to a preferred embodiment of the present invention;

FIG. 2 is a cross-sectional view taken generally along line 2—2 of FIG. 1;

FIG. 6 is a perspective view of an alternate embodiment of the diving mask of FIG. 1;

FIG. 7 is a partial front view of the mask of FIG. 1 showing an alternate embodiment of an actuator according to a preferred embodiment of the invention;

DETAILED DESCRIPTION OF THE PREFERRED EMBODIMENT

Figure 3:
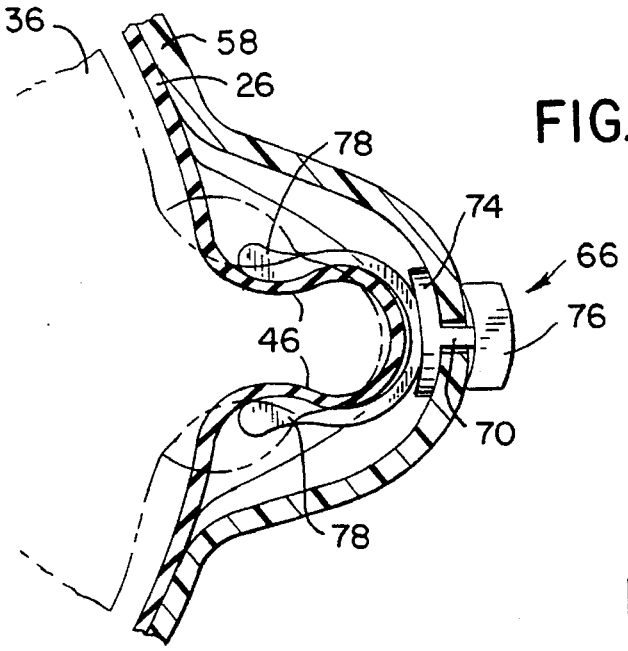
FIG. 3 is a cross-sectional view taken generally along the line 3—3 of FIG. 2.

Referring generally to FIGS. 1 and 2, a diving mask 20, of the type typically used for scuba diving or skin diving, is illustrated. Diving mask 20 includes a frame 22, a lens 24, and a flexible skirt 26.

Frame 22 is typically a perimeter frame, having a top 28, a bottom 30, and a pair of sides 32. Top 28, bottom 30, and sides 32 define an opening 34 in which lens 24 is mounted. Lens 24 is also sealed to frame 22 to prevent water from flowing between frame 22 and lens 24 during diving.

Flexible skirt 26 is also attached to frame 22 and extends generally away from lens 24. Flexible skirt 26 is sealed to frame 22 to prevent water from moving into the interior of diving mask 20 between frame 22 and flexible skirt 26.

Many modern masks form flexible skirt 26 from a silicone material to promote comfort and a water-tight fit against the face of a diver 36. To promote this water-tight fit, a sealing flange 38 extends about at least a substantial portion of the edge of flexible skirt 26 that abuts the face of diver 36. Thus, when diving mask 20 is properly positioned against the face of diver 36, an air pocket 40 is formed between lens 24 and the diver's face. A mask strap 41 is attached to sides 32 of frame 22 and is designed to extend about the back of the head of diver 36. The mask strap secures diving mask 20 against the diver's face.

In the illustrated embodiment, flexible skirt 36 also includes a flexible nosepiece 42. This flexible nosepiece is illustrated as partially cut away in the cross-sectional view of FIG. 2. Preferably, flexible nosepiece 42 includes a bottom panel 44 and a pair of side panels 46. Bottom panel 44 and side panels 46 cooperate to create a cavity into which extends a nose 48 of diver 36 when diving mask 20 is positioned on the diver's face.

Figure 5:
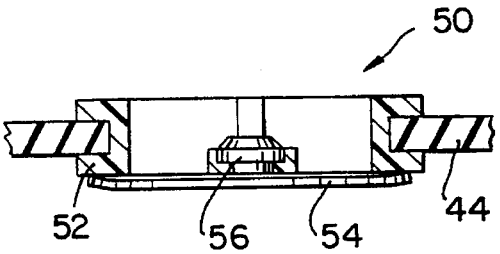
FIG. 5 is an enlarged view of the purge valve shown in FIGS. 2 and 4.

Diving mask 20 can also include a purge valve 50 as best illustrated in FIGS. 2 and 5. Purge valve 50 includes a stiff outer ring 52 to which a flexible panel 54 is attached. Purge valve 50 also includes an internal support structure 56 connected to flexible panel 54 at a generally central location. Thus, when diver 36 breathes outwardly through his or her nose, internal support structure 56 holds the central area of flexible panel 54 permitting the remainder of flexible panel 54 to flex downwardly and expel air and water into the environment. In this manner, diver 36 is able to maintain air pocket 40 generally free from water.

As illustrated, diving mask 20 also includes a bracket 58 that is preferably a stiff plastic material. Bracket 58 is connected to frame 20 at a location generally above and outward from the bridge of the diver's nose 48. Bracket 58, however, can be attached to frame 22 in a variety of ways known to those of ordinary skill in the art. For example, an upper hooked end 60 can be hooked into a corresponding component of the frame 22 and/or flexible skirt 26 by an appropriate adhesive. Additionally, a lower member 62 of bracket 58 can be located in a slot 64 formed in flexible nosepiece 42. In any event, bracket 58 is located outwardly of flexible nosepiece 42 to cover at least a portion of the nosepiece. Preferably, bracket 58 also includes a bottom guide 65 that extends along the bottom of mask 20 below purge valve 50. Bottom guide 65 helps direct air bubbles exiting purge valve 50 away from the eyes of diver 36.

An actuator 66 is at least partially mounted to bracket 58 and can have a variety of configurations. When actuator 66 is moved or actuated, it squeezes nose 48 and restricts airflow therethrough. The diver 36 is able to equalize the internal and external pressure on his body without actually physically squeezing his nose with his fingers. This permits diving mask 20 to be designed with a variety of purge valves 50 or rigid brackets 58 while still allowing diver 36 to restrict airflow through nose 48 via actuator 66.

Figure 4:
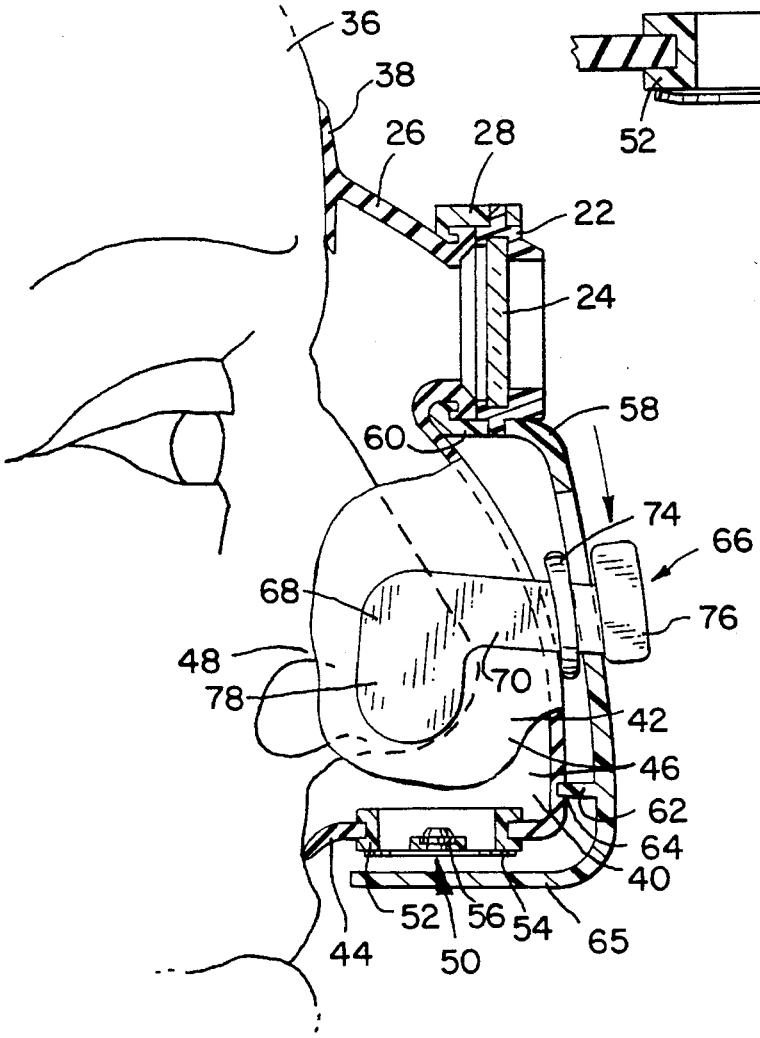
FIG. 4 is a cross-sectional view similar to that of FIG. 2 showing the actuator in an actuated position.

In the specific embodiment illustrated in Figures 2–4, actuator 66 includes a nose pinching mechanism 68, such as a nose clip designed to slide over each side of the diver's nose and squeeze the nose shut to a point that restricts airflow therethrough. Nose clip 68 is mounted on a slide bar 70 which, in turn, extends through a slot 72 formed in bracket 58. The proper orientation of actuator 66 is maintained by an internal guide 74 designed to slide along the interior of bracket 58 and an external push button 76 designed to slide along the external surface of bracket 58.

Actuator 66 is shown in an unmoved or unactuated position in FIG. 2. In this position, diver 36 is free to exhale air through his nose and through purge valve 50. However, when actuator 66 is moved or placed in the actuated position, as shown in FIG. 4, the diver's nose 48 is at least substantially squeezed shut to restrict or prevent airflow therethrough. Preferably, nose pinching mechanism 68 includes a pair of tabs 78, as best illustrated in FIG. 3. Tabs 78 are typically made of plastic and are flexible enough to slide over the nose 48. However, tabs 78 must be sufficiently close together and stiff to squeeze nose 48 and restrict or block airflow.

It should be noted that actuator 66, regardless of the specific form used, can be combined with numerous styles of diving masks 20. For example, diving mask 20 may be of the dual window design illustrated in FIG. 6. In this design, the single lens is replaced with a pair of lens 80. Accordingly, frame 22 includes a center bar 82 between diving lenses 80.

For the remainder of this description, a single lens mask, such as the one illustrated in FIG. 1, will be used to describe a series of alternate embodiments of actuator 66. For ease of understanding, the reference numerals denoting aspects of diving mask 20 will remain the same, and only the reference numerals used to describe the elements of the alternate actuators will be changed.

Figure 8:
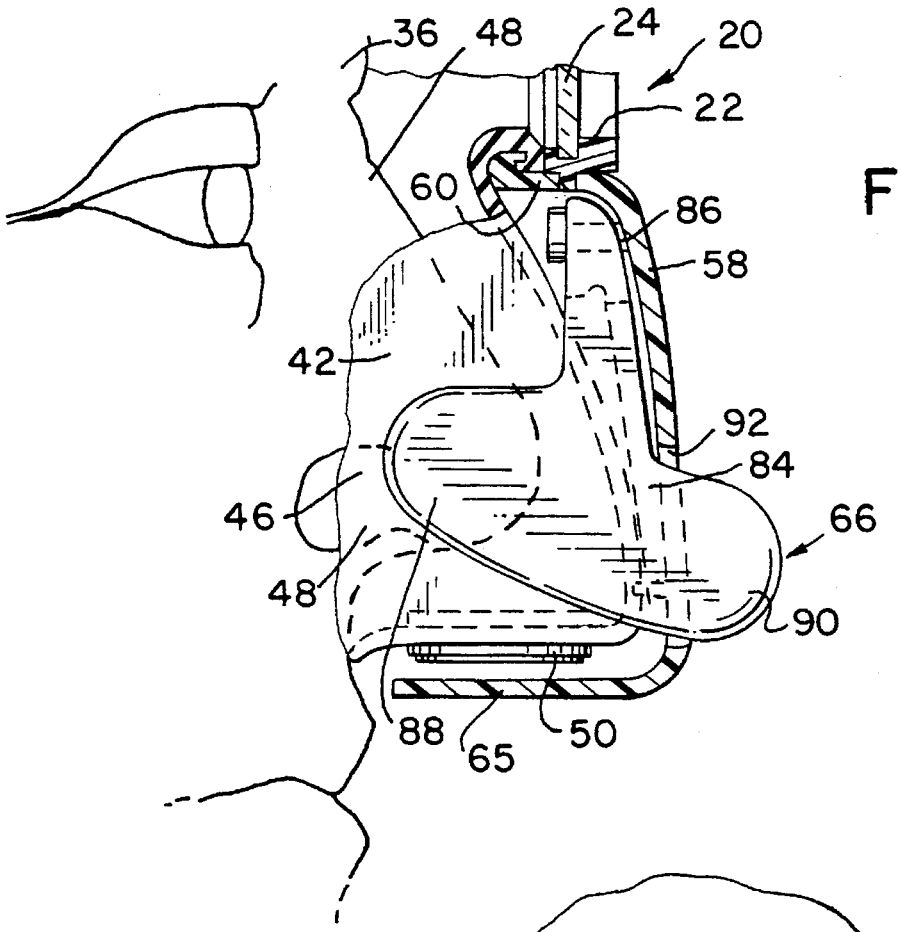
FIG. 8 is a cross-sectional view taken generally along line 8—8 of FIG. 7.
Figure 9:
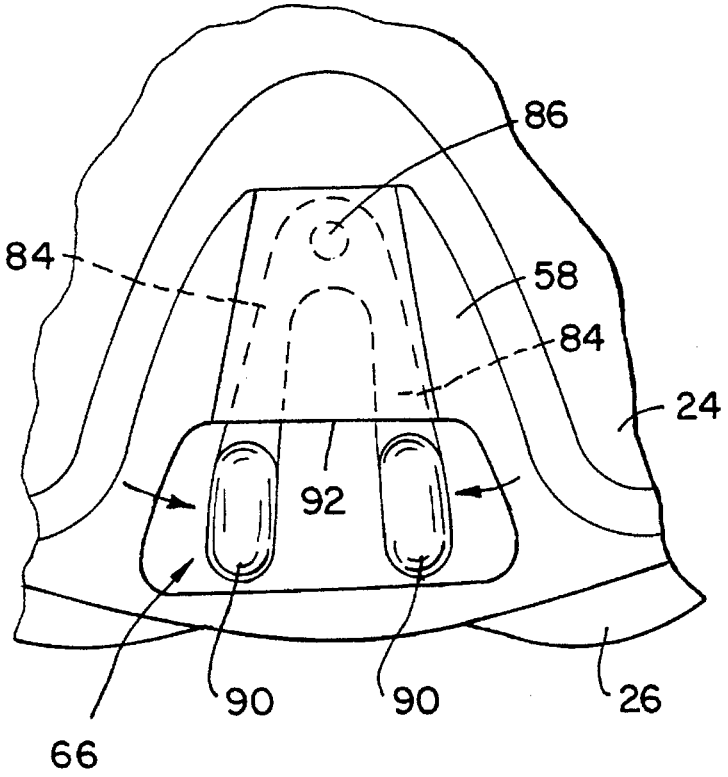
FIG. 9 is a cut out portion of FIG. 7 showing the actuator in an actuated position.

Referring to FIGS. 7–9, an alternate embodiment of actuator 66 is illustrated. In this embodiment, a pair of arms 84 are mounted to bracket 58 via a pin 86. Arms 84 could also be mounted to frame 22.

The illustrated arms 84 are flexible arms that can be squeezed towards one another to pinch off nose 48. However, arms 84 could also be independently pivotably mounted on pin 86 or another type of mount and held apart by a resilient member such as a spring (not shown).

Preferably, each arm 84 includes an inwardly extending protrusion 88 that overlaps nose 48. Additionally, each arm 84 includes an outwardly extending protrusion or gripping portion 90 that extends outwardly of bracket 58 through a generally horizontal gap 92. Diver 36 simply grabs the gripping portion 90 of each arm 84 and squeezes arms 84 towards one another, as illustrated in FIG. 9, until nose 48 is sufficiently squeezed to facilitate pressure equalization.

Figure 10:
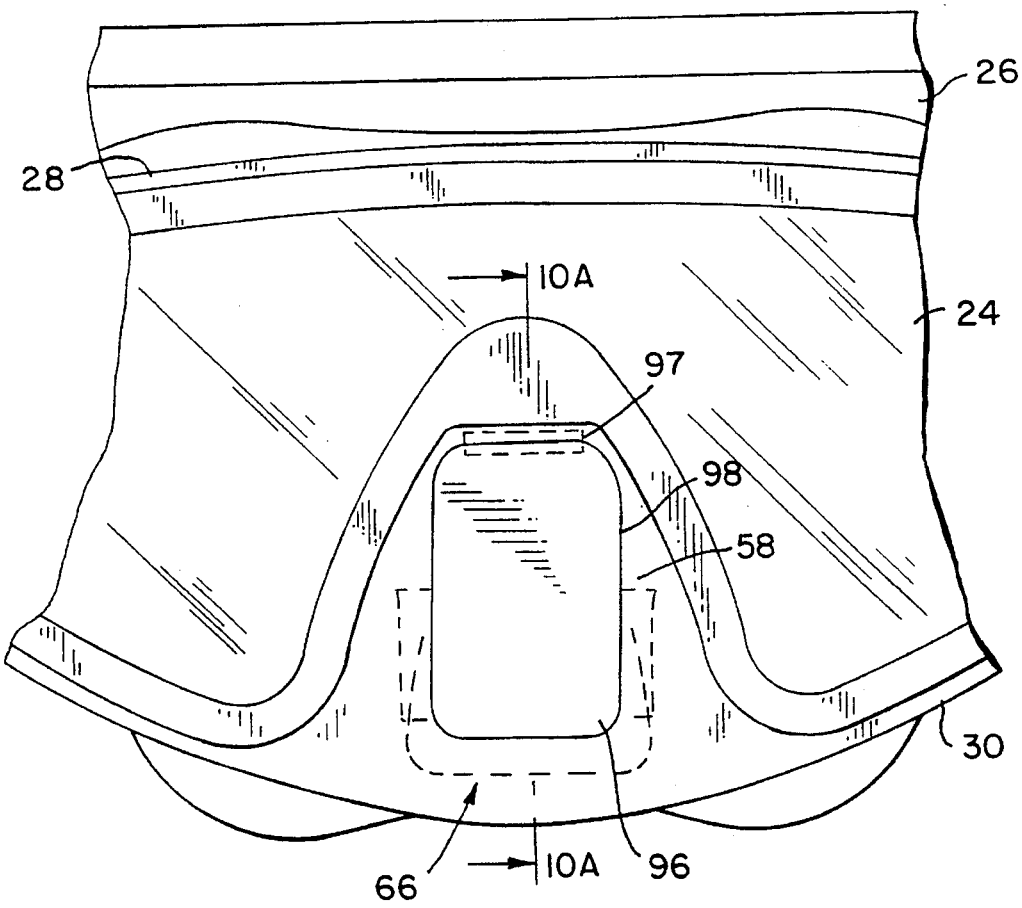
FIG. 10 is a partial front view of the diving mask of FIG. 1 illustrating an alternate embodiment of the actuator according to a preferred embodiment of the invention.
Figure 11:
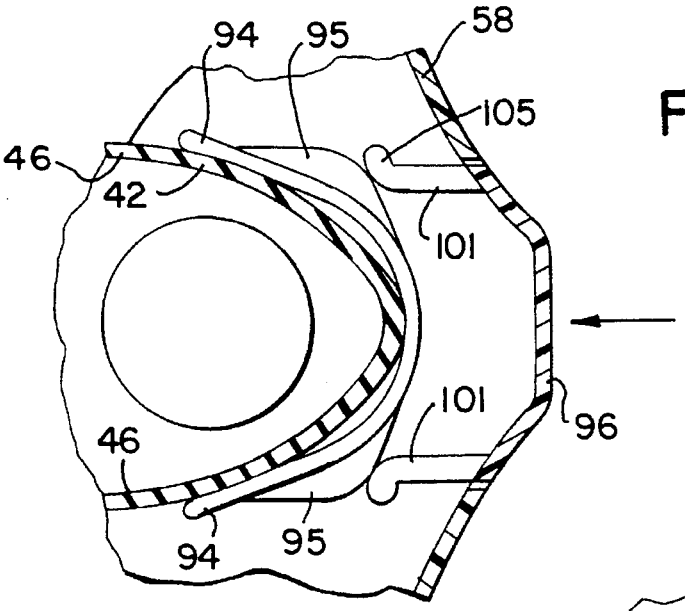
FIG. 11 is a cross-sectional view taken generally along line 11—11 of FIG. 10A, showing a modified nose squeezing mechanism.
Figure 11A:
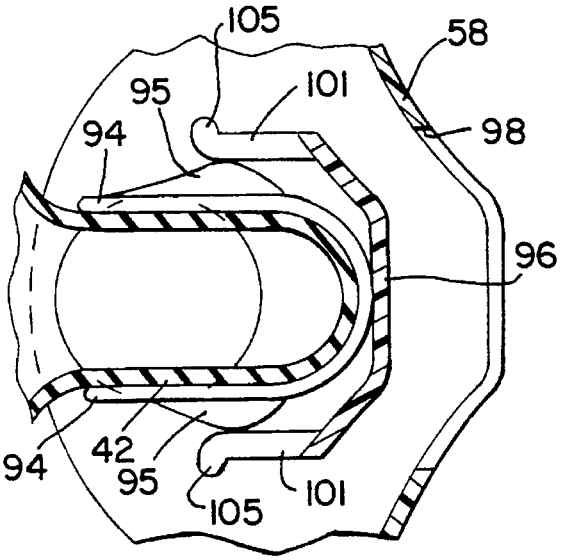
FIG. 11A is a cross-sectional view similar to that of FIG. 11, but showing the nose squeezing mechanism in an actuated position.

Another embodiment of actuator 66 is illustrated in FIGS. 10 through 11A. In this embodiment, actuator 66 includes a nose pinching mechanism 93 that has a pair of tabs 94. Tabs 94 are preferably connected to one another and extend along flexible nosepiece 42 as best illustrated in FIG. 11. Tabs 94 can either be attached to nosepiece 42 or mounted to bracket 58 if greater stability is desired. Each tab 94 includes an outwardly extending cam 95. When cams 95 are pressed generally towards one another, tabs 94 force flexible nosepiece 42 together, thereby squeezing nose 48 and restricting or preventing airflow therethrough. This restricted or squeezed position is illustrated best in FIG. 11A.

Figure 10A:
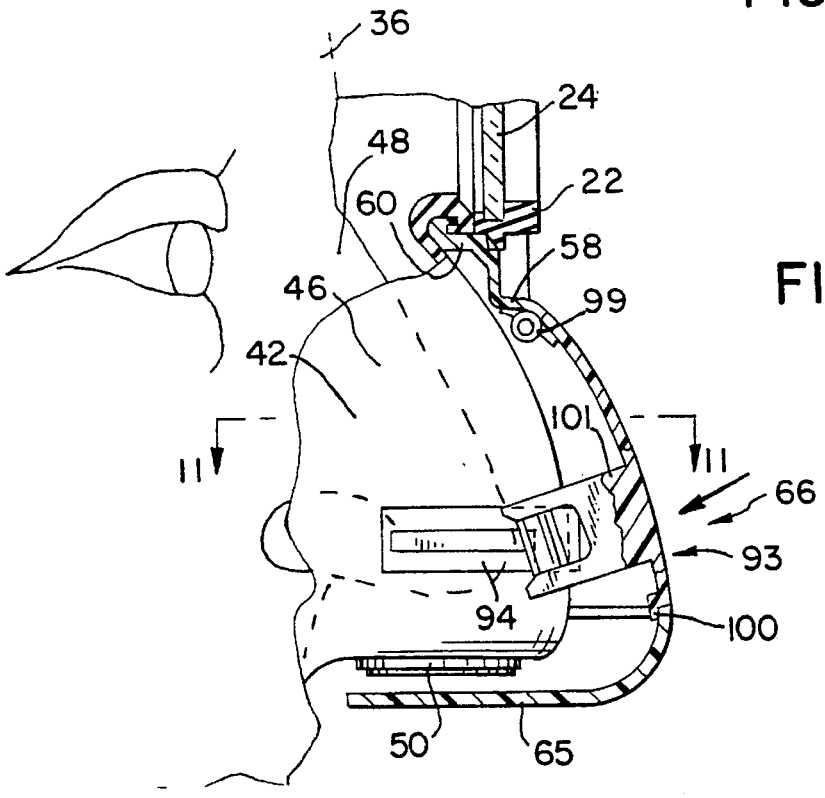
FIG. 10A is a cross-sectional view taken generally along line 10A—10A of FIG. 10.
Figure 10B:
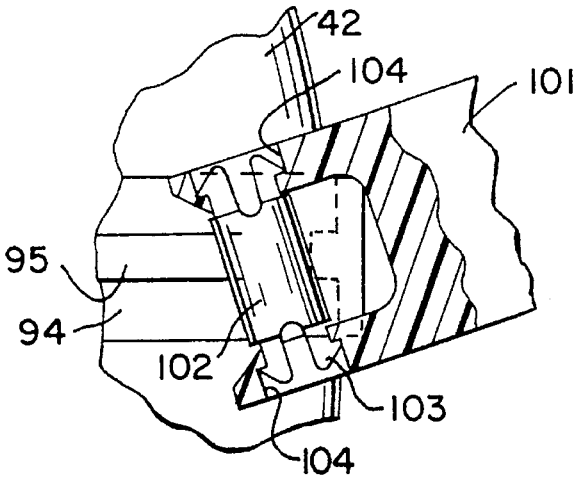
FIG. 10B is on expanded view of the roller pin of FIG. 10A.

A variety of mechanisms can be used to squeeze tabs 94 together. Once such embodiment is illustrated in FIGS. 10–10B and another is illustrated in FIGS. 11 and 11A. With either mechanism, a pivotable portion 96 of bracket 58 is created and mounted on a hinge 97. Hinge 97 is preferably mounted towards the top of pivotable portion 96 as illustrated in FIG. 10. Pivotable portion 96 is separated from the remainder of bracket 58 along a perimeter 98.

Hinge 97 may comprise a variety of hinge types, including living hinges. With certain materials, the natural resiliency of the material may be enough to return pivotal portion 96 to its unactuated state as illustrated in FIG. 10A. However, it can be beneficial to attach a spring 99 proximate hinge 97 between pivotable portion 96 and the remainder of bracket 58. Additionally, pivotable portion 96 preferably includes a stop 100 to restrict its outward movement when returned to its unactuated position by spring 99. (See FIG. 10A)

A pair of arms 101 are attached to pivotable portion 96 and extend inwardly into cooperation with cams 95. When pivotable portion 96 is in its unactuated state, arms 101 do not force cams 95 and tabs 94 inwardly to permit airflow through nose 48. However, when pivotable portion 96 is actuated, i.e., moved inwardly, arms 101 slide along cams 95 and force tabs 94 inwardly to restrict or prevent airflow through nose 48 (See FIG. 11A).

In FIGS. 10A and 10B, each arm includes a roller pin 102 having flanged ends 103 rotatably mounted in appropriately designed corresponding apertures 104 formed in the ends of arms 101. Thus, flanged ends 103 can simply be snapped into apertures 104 and held in place by the annular ridge as illustrated in each aperture 104.

In one alternate embodiment, roller pins 102 can be replaced by solid ears 105 as illustrated in FIGS. 11 and 11A. Ears 105 slide along cams 95 forcing tabs 94 inwardly (See FIG. 11A) similar to roller pin 102. Regardless of whether the roller pin mechanism illustrated in FIGS. 10A and 10B or the arms with solid ears illustrated in FIGS. 11 and 11A is used, the principle remains the same. Inward movement of pivotal portion 96 forces arms 101 to engage cams 95 and force tabs 94 to squeeze both nosepiece 42 and nose 48.

Figure 12:
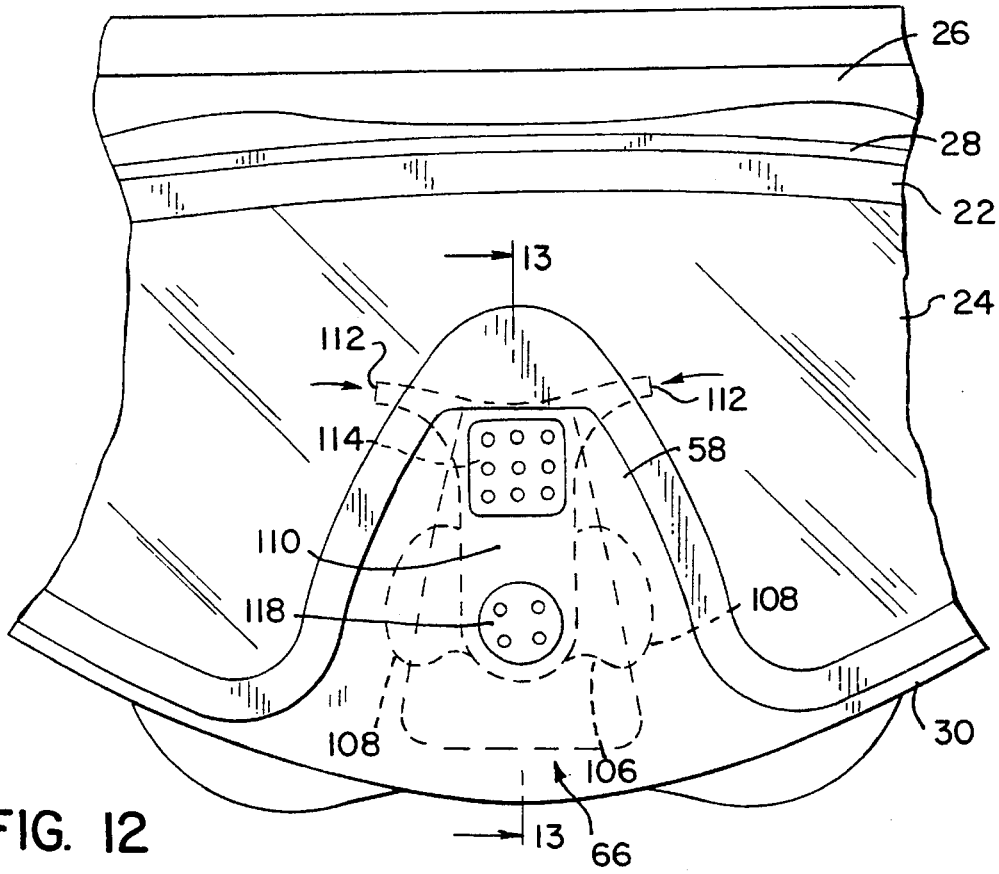
FIG. 12 is a partial front view of the diving mask of FIG. 1 illustrating an alternate embodiment of the actuator according to a preferred embodiment of the invention.
Figure 13:
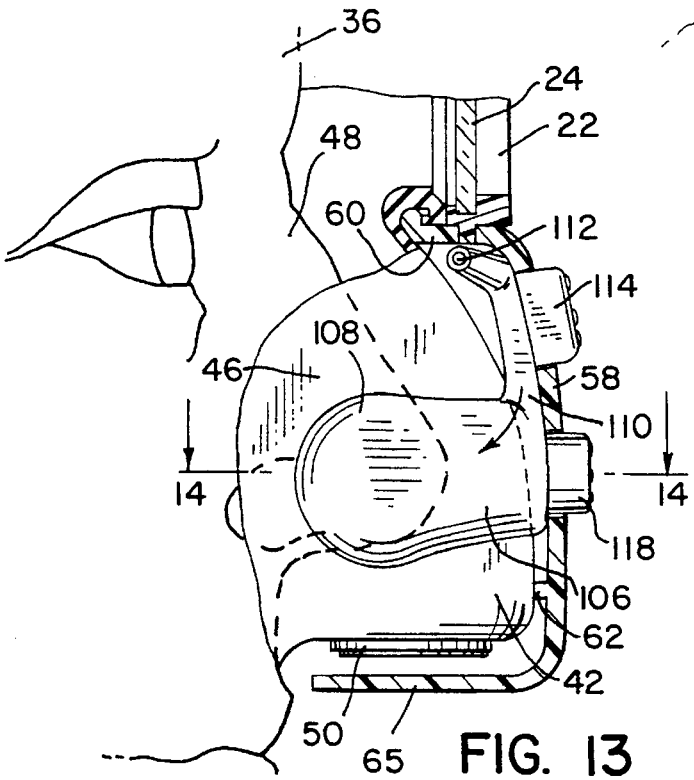
FIG. 13 is a cross-sectional view taken generally along line 13—13 of FIG. 12.
Figure 14:
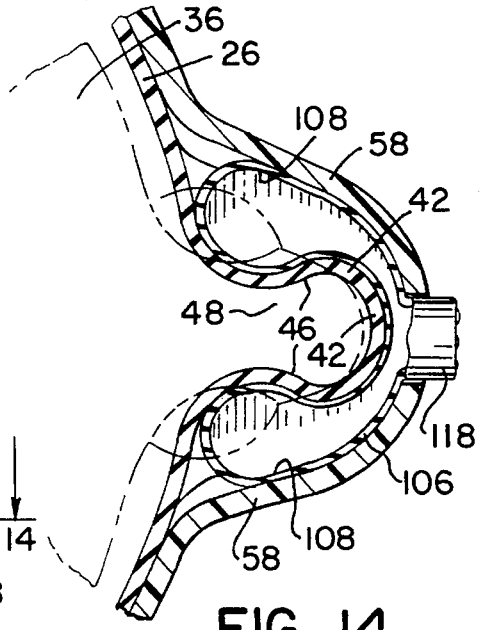
FIG. 14 is a cross-sectional view taken generally along line 14—14 of FIG. 13.

Another embodiment of actuator 66 is illustrated in FIGS. 12–14. In this embodiment, a bladder 106 is divided into a pair of bladder sections 108. Bladder sections 108 are disposed on opposite sides of nose 48 and are located to restrict or block airflow through nose 48 when inflated as illustrated in FIG. 14. Bladder 106 is in fluid communication with a fluid channel 110 that has a fluid inlet, and preferably a pair of inlets 112. Potentially, fluid inlets 112 can be disposed on the interior of diving mask 20 to receive air from air pocket 40. In the alternative, fluid inlets 112 can be disposed on the exterior of diving mask 20 to receive water for use in inflating bladder 106.

A pump 114 is connected to channel 110 and extends through bracket 58, as illustrated in FIG. 13. When pump 114 is pressed by diver 36, the fluid therein is prevented from exiting fluid inlets 112 by a one-way valve prevented from exiting fluid inlets 112 by a one-way valve 116. Thus, the fluid is forced into bladder 106 which inflates and squeezes nose 48. When diver 36 releases pump 114, additional fluid is pulled through fluid inlets 112 and one way valve 116 into pump 114. If necessary, that fluid can also be forced into bladder 106 by pressing pump 114. A variety of valves 116 can be used as would be known to those of ordinary skill in the art. For example, a valve similar to purge valve 50 could be located in channel 110.

When diver 36 has completed his or her equalization process, the fluid within bladder 106 is released to the surrounding environment by a release valve 118. As diver 36 presses release valve 118, the fluid within bladder 106 flows outwardly to the surrounding environment through an appropriately located orifice (not shown). This effectively reduces the size of bladder sections 108 to permit diver 36 to exhale through his nose and purge valve 50.

In each of the embodiments illustrated in Figures 1–14, the actuator 66 is designed to press externally on side panels 46 of flexible nosepiece 42. Thus, nosepiece 42 is squeezed against nose 48 of diver 36 to restrict or prevent airflow therethrough. However, it is within the scope of this invention to integrate the actuator with the flexible nosepiece or to even place portions of the actuator internal to the flexible nosepiece. For example, bladder sections 108 could be formed internally to or in place of flexible nosepiece 42 by directing channel 110 through the material of nosepiece 42.

It will be understood that the foregoing description is of preferred exemplary embodiments of this invention and that the invention is not limited to the specific form shown. For example, numerous configurations of diving masks can be used, various materials can be used and those materials can be adhered to one another or adjoined in a variety of ways that would be understood by those of ordinary skill in the art. Additionally, the diving mask can be formed with or without a purge value and with or without a rigid mounting bracket for certain types of actuators. These and other modifications may be made in the design and arrangement of the elements without departing form the scope of the invention as expressed in the appended claims.

What is claimed is:

1. A diving mask for use by a diver, the diving mask creating an interior pocket of air bounded by an interior of the mask and at least part of the face of the diver when worn by the diver, comprising:

a frame;

a lens sealingly mounted in the frame;

a flexible skirt mounted to the frame, the flexible skirt including a nosepiece configured to fit over the nose of the diver;

a bracket mounted to the frame and disposed at least partially over the nosepiece; and an actuator connected to the bracket and including a nose pinching element, the actuator being movable, wherein upon sufficient movement of the actuator, the nosepiece is squeezed inwardly by the nose pinching element to a position that would restrict airflow through the diver's nose when positioned within the nosepiece.

2. The diving mask as recited in claim 1, wherein the nose pinching element comprises a nose clip attached to a bar slidably mounted in the bracket.

3. The diving mask as recited in claim 2, wherein the bracket includes a slot through which the bar extends, the bar cooperating with a guide that maintains the bar at an appropriate orientation as is it moved along the slot.

4. The diving mask as recited in claim 1, wherein the nose pinching element comprises a pair of arms that may be moved towards one another to restrict airflow through the diver's nose.

5. The diving mask as recited in claim 4, wherein each arm is flexible and includes a gripping portion that extends outwardly from the bracket.

6. The diving mask as recited in claim 1, wherein the nose pinching element comprises a pair of noseclip tabs and a pivotable portion of the bracket, the pivotable portion being mounted on a hinge and disposed for selective engagement with the pair of noseclip tabs.

7. The diving mask as recited in claim 6, wherein the noseclip tabs each have a cam and the bracket includes a pair of arms that interact with the cams.

8. The diving mask as recited in claim 7, wherein the hinge is oriented to permit the pivotable portion to be pivoted generally towards the diver's nose when placed in the nosepiece and each arm of the pair of arms includes a roller.

9. The diving mask as recited in claim 1, wherein the nose pinching element comprises an inflatable bladder disposed to act in cooperation with the nosepiece.

10. The diving mask as recited in claim 9, wherein the nose pinching element comprises a channel disposed in fluid communication with the bladder and a pump disposed in fluid communication with the channel to pump fluid into the bladder.

11. The diving mask as recited in claim 10, wherein the nose pinching element comprises a release valve in fluid communication with the bladder to release fluid from the bladder.

12. The diving mask as recited in claim 11, wherein the channel includes a fluid entry port disposed to receive air from the interior pocket.

13. The diving mask as recited in claim 11, wherein the channel includes a fluid entry port disposed to receive water from the environment surrounding the diving mask.

14. A diving mask designed to fit over a nose and a pair of eyes of a diver to create a pocket of air bounded by an interior of the mask and at least part of a face of the diver, comprising:

a frame having a top, a bottom, and a pair of sides that cooperate to form at lease one opening;

a lens mounted and sealed within the at least one opening;

a flexible skirt mounted to the frame, the flexible skirt including a flexible nosepiece having a bottom panel and a pair of side panels configured to fit over the nose of the diver;

a stiff bracket mounted to the frame to extend at least partially over the nosepiece; and an actuator at least partially mounted to the stiff bracket for cooperation with the nosepiece, wherein the actuator includes a nose pinching mechanism that, upon actuation, squeezes each side panel of the pair of side panels towards the other side panel to squeeze the nose of the diver and restrict airflow therethrough.

15. The diving mask as recited in claim 14, further comprising a purge valve disposed in the bottom panel.

16. The diving mask as recited in claim 15, wherein the nose pinching mechanism is mounted to a slide bar and the bracket includes a slot for receiving the slide bar.

17. The diving mask as recited in claim 15, wherein the nose pinching mechanism includes a pair of arms that are each movable towards the other, each arm having a gripping portion that extends outwardly beyond the bracket.

18. The diving mask as recited in claim 15, wherein the bracket includes a pivotable panel that can be pivoted towards the nose of the diver, the nose pinching mechanism being mounted to the pivotable panel.

19. The diving mask as recited in claim 15, wherein the nose pinching mechanism includes an inflatable bladder disposed to squeeze the nose when inflated.

* * * * *